US006260381B1

(12) United States Patent
Zettl

(10) Patent No.: US 6,260,381 B1
(45) Date of Patent: Jul. 17, 2001

(54) ARTICLE OF JEWELRY

(75) Inventor: Friedrich Zettl, Birkenfeld (DE)

(73) Assignee: Friedrich Zettl GmbH, Birkenfeld (DE)

( * ) Notice: Subject to any disclaimer, the term of this patent is extended or adjusted under 35 U.S.C. 154(b) by 0 days.

(21) Appl. No.: 09/230,238

(22) PCT Filed: May 9, 1998

(86) PCT No.: PCT/EP98/02721

§ 371 Date: May 7, 1999

§ 102(e) Date: May 7, 1999

(87) PCT Pub. No.: WO98/54999

PCT Pub. Date: Dec. 10, 1998

(30) Foreign Application Priority Data

Jun. 2, 1997 (DE) ..... 197 23 017
Apr. 30, 1998 (DE) ..... 198 19 427

(51) Int. Cl.[7] ..... A44C 7/00

(52) U.S. Cl. ..... 63/12; 63/3; 63/7; 63/8; 63/14.1; 63/14.4; 63/14.5

(58) Field of Search ..... 63/12, 13, 14.1, 63/14.4, 14.5, 3, 7, 8

(56) References Cited

U.S. PATENT DOCUMENTS

| | | | | |
|---|---|---|---|---|
| 237,344 | * | 2/1881 | Vester | 63/8 |
| 809,619 | * | 1/1906 | Lettre | 63/8 |
| 827,164 | * | 7/1906 | Macomber | 63/8 |
| 993,304 | * | 5/1911 | Kirby | 63/8 |
| 993,305 | * | 5/1911 | Kirby | 63/8 |
| 1,002,922 | * | 9/1911 | Lederer | 63/7 |

FOREIGN PATENT DOCUMENTS

| | | | | |
|---|---|---|---|---|
| 5609 | * | 4/1915 | (GB) | 63/8 |

* cited by examiner

*Primary Examiner*—Anthony Knight
*Assistant Examiner*—Andrea Chop
(74) *Attorney, Agent, or Firm*—Laff, Whitesel & Saret, Ltd.; J. Warren Whitesel

(57) ABSTRACT

An article of jewelry has a first (5) and a second part (3) and a hinge (7) which articulatedly connects the two parts (3, 5) in such a way that the parts (3, 5) are movable between a first closed position and a second opened position. The article of jewelry is characterized in that a spring (21) is provided which forces the two parts (3, 5) into the closed position.

11 Claims, 13 Drawing Sheets

ARTICLE OF JEWELRY

BACKGROUND OF THE INVENTION

The present invention relates to an article of jewelry having a first and a second part and a hinge which articulatedly connects the two parts in such a way that the parts are movable between a first closed position and a second opened position.

The document DE 34 34 475 A1 discloses an earring which is composed of two parts that are articulatedly connected to one another via a hinge. Articulated connections of this kind are also known in bangles. In general terms, they make the article of jewelry easier to put on.

The earring shown in the aforesaid document is held in its closed position via a snap-lock mechanism which comprises a resilient pin with a notch on the one side, and a lug snapping into the notch on the other side. Since the spring pin engages through the pierced ear, its maximum diameter is limited. Limits are thereby also placed, however, on the spring force and stability of said spring pin. As a result it may happen that after a certain time the snap-lock mechanism no longer functions properly. In the worst case, the earring is then lost.

In addition, the hinge mechanism of the known earring, despite its inherently good operation, is capable of further improvement in order especially to further enhance operating and wearing convenience.

SUMMARY OF THE INVENTION

Against this background, the object of the invention is to develop an article of jewelry of the kind cited initially in such a way that on the one hand the closure mechanism is reinforced, and on the other hand operating and wearing convenience is enhanced.

In an article of jewelry of the kind cited initially, this object is achieved in that a spring means is provided which forces the two parts into the closed position.

The advantage of this spring means is on the one hand that protection against inadvertent opening of the article of jewelry is increased and the closure mechanism is assisted. On the other hand, it is substantially easier to put on the article of jewelry due to the good positional retention of the individual parts and the closing of the article of jewelry effected by the spring means.

In an advantageous embodiment of the invention, at least the first part is of hollow configuration, and the spring means is arranged inside the first part.

This has the advantage that the spring means is not visible externally, which is very important especially in articles of jewelry.

In an advantageous development of the invention, the spring means has a helical spring. The helical spring is preferably made from the same material as the two parts.

This has the advantage that a physically simple and thus economical configuration of the spring means is achieved.

In an advantageous development of the invention, the hinge comprises a first hinge part associated with the first part, and a second hinge part associated with the second part, as well as a retaining element, the retaining element connecting the two hinge parts to one another, and the spring means being fastened on the one hand to the retaining element and on the other hand to the first part. Preferably the retaining element is attached rotatably to the second hinge part and is connected to the first part via the spring means.

Preferably the first hinge part and the retaining element are configured such that the first part is displaced relative to the retaining element during movement into the opened position.

This configuration of the article of jewelry has proven to be particularly advantageous in terms of function and design complexity.

In an advantageous development of the invention, the first hinge part comprises a tapering recess, having a wall, at the base of which an opening passing through the hinge part is provided; and the second hinge part comprises a longitudinal segment, adapted to the shape of the recess, which projects into the recess; and the retaining element has a first longitudinal segment engaging through the opening, and a second longitudinal segment adjacent thereto, a shoulder which rests against the wall of the recess being formed between the first and the second longitudinal segment.

This has the advantage of making possible, with simple means, the displacement of the first part relative to the retaining element during movement into the opened position. During movement into the opened position, a region of the longitudinal segment braces against the wall of the recess and thus forms more or less the pivot point of the two parts. The position of the retaining element relative to the first part thereby changes, so that the spring means are tensioned.

In an advantageous development of the invention, there is provided at the base of the recess a partially cylindrical further recess; and the second hinge part has a segment which is adapted to the shape of the further recess and which, in the closed position, engages into the further recess.

This has the advantage that upon closing, the first part is forced into a defined position. The further recess and the segment adapted thereto thus act as alignment or centering means.

In an advantageous embodiment of the invention, the first part has a stop means which is arranged spaced away from the first hinge part; and the spring element is attached on the one hand to the stop means and on the other hand to the retaining element, so that the spring means extends between the first hinge part and the stop means.

This has the advantage that the spring means along with the article of jewelry is of very simple design and thus can be implemented economically.

In an advantageous development of the invention, the two hinge parts have surfaces facing one another; and the two surfaces are configured such that a rotation of one of the two parts about its longitudinal axis results in a displacement of that part in the longitudinal direction.

In an advantageous development of the invention, the first longitudinal segment of the retaining element has a supporting surface; and the spring means extends along the first longitudinal segment and is supported on the one hand against the supporting surface and on the other hand against the first hinge part. With this embodiment, the spring means is stressed in compression, since the spring means is compressed when the two parts are opened.

The advantage of this embodiment is that the hinge, together with the spring means, can be completely prefabricated. It simply needs to be inserted into the first or second part. Joining of the spring means to the first part is not necessary.

The article of jewelry is preferably configured as an earring, the first part and second part being configured in tubular fashion and forming, in the closed position, a continuous and preferably circular contour. The article of jewelry can also, however, be a bangle.

Further advantages and embodiments of the invention are evident from the description and the appended drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

The invention will now be explained in more detail with reference to exemplifying embodiments, with reference to the appended drawings in which:

FIGS. 2(I) and 2(II) are two schematic views of two components which, respectively, show two hinge parts 9, 11 and a retaining part 13, with each component being shown in both a plan view and in cross section view.

DETAILED DESCRIPTION OF THE INVENTION

Figure 1:
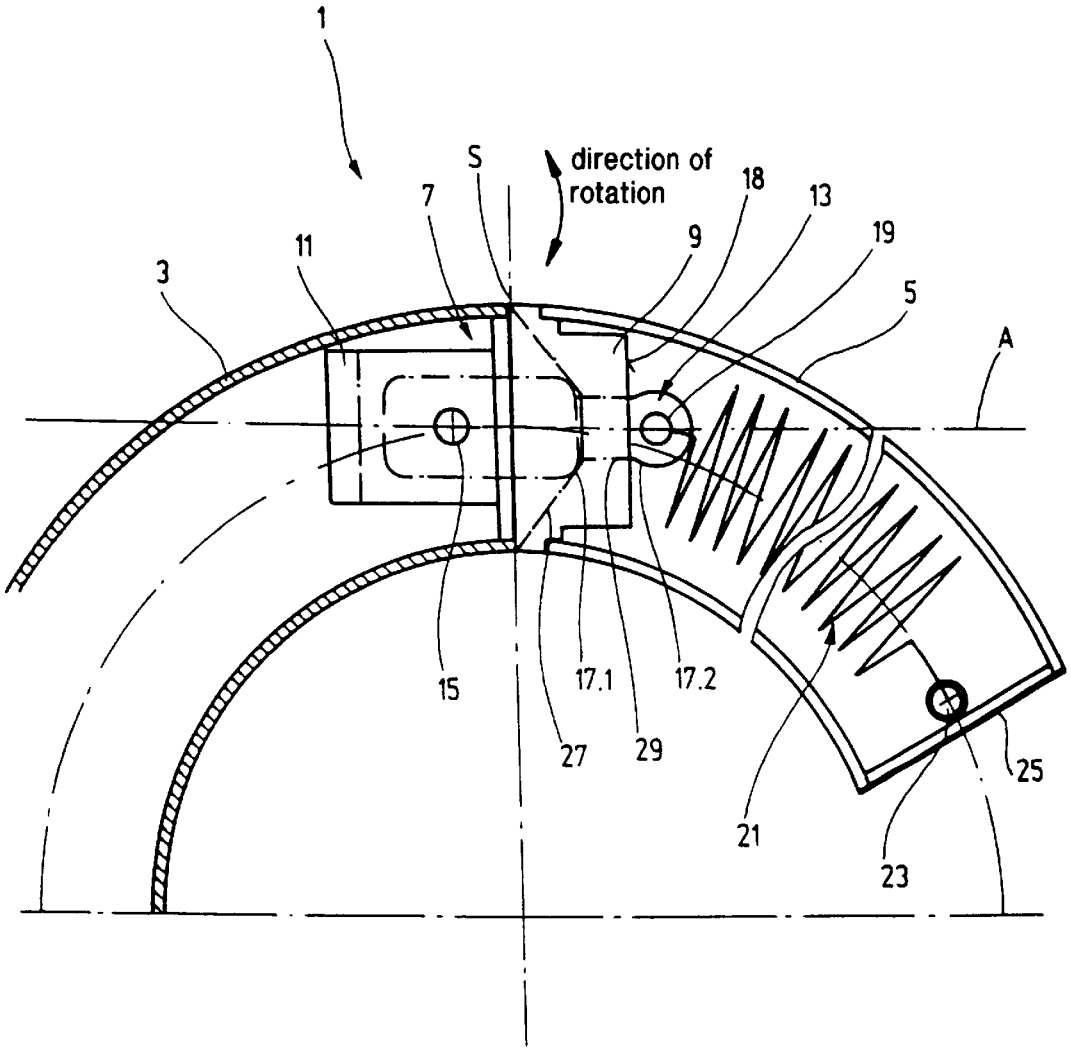
FIG. 1 shows a schematic depiction of the hinge in accordance with a first exemplifying embodiment.

Purely by way of example, the article of jewelry according to the present invention is explained with reference to an earring, namely a so-called hinged hoop. It is understood that the invention is not limited to earrings; rather the hinge with spring mechanism explained below is also usable, for example, in bangles. In FIGS. 1 through 13 described below, identical reference characters are used throughout for identical parts. For the sake of simplicity, parts already described will therefore not be described again.

FIG. 1 shows a portion of a hinged hoop 1 which comprises two parts 3, 5 connected in hinged or articulated fashion to one another at a point S. The two parts 3, 5 are of tubular, i.e. hollow, configuration, and preferably have a circular cross section. Other cross sections are, of course, also possible. The two parts 3, 5 are, when seen in plan view, configured so that they form a closed shape, for example a circle. Mounted at the ends of the two parts 3, 5 facing away from connection point S is a closure mechanism which has, for example, a pin which coacts in snap-lock fashion with a pin receptacle. For the sake of clarity, this closure mechanism is not shown in the Figures. An appropriate disclosure and explanation of a closure mechanism of this kind is found in the document DE 34 34 475 A1.

A hinge 7 connecting the two parts 3, 5 comprises a first hinge part 9 associated with part 5, and a second hinge part 11 associated with part 3. The two hinge parts 9, 11 are connected to one another via an elongated tab 13, tab 13 being connected via a pin 15 to second hinge part 11 rotatably about an axis running perpendicular to the drawing plane. The end of tab 13 facing toward first hinge part 9 is received in first hinge part 9 displaceably in the direction of an axis A, that displaceability being limited, however, by stops 17.1 and 17.2. Stop 17.1 coacts with the surface of first hinge part 9 facing toward part 13, while stop 17.2 coacts with a surface 18 which faces away from part 3.

Tab 13 has an eye 19 which lies in the interior of part 5. A helical spring 21 is attached with one of its ends to this eye 19. The other end of spring 21 is attached to an eye 23 connected immovably to part 5. Eye 23 is preferably a constituent of a cover 25 closing off part 5 at its longitudinal end. Spring 21, preferably made from a noble metal, is designed so that it pulls tab 13 with its stop 17.1 against first hinge part 9.

It is also evident from FIG. 1 that first hinge part 9 has a conical recess 27 which extends in the direction of surface 18 from the side of hinge part 9 facing toward part 3. A correspondingly adapted, i.e. conical, longitudinal segment of second hinge part 11 engages into this recess 27.

Figure 2:
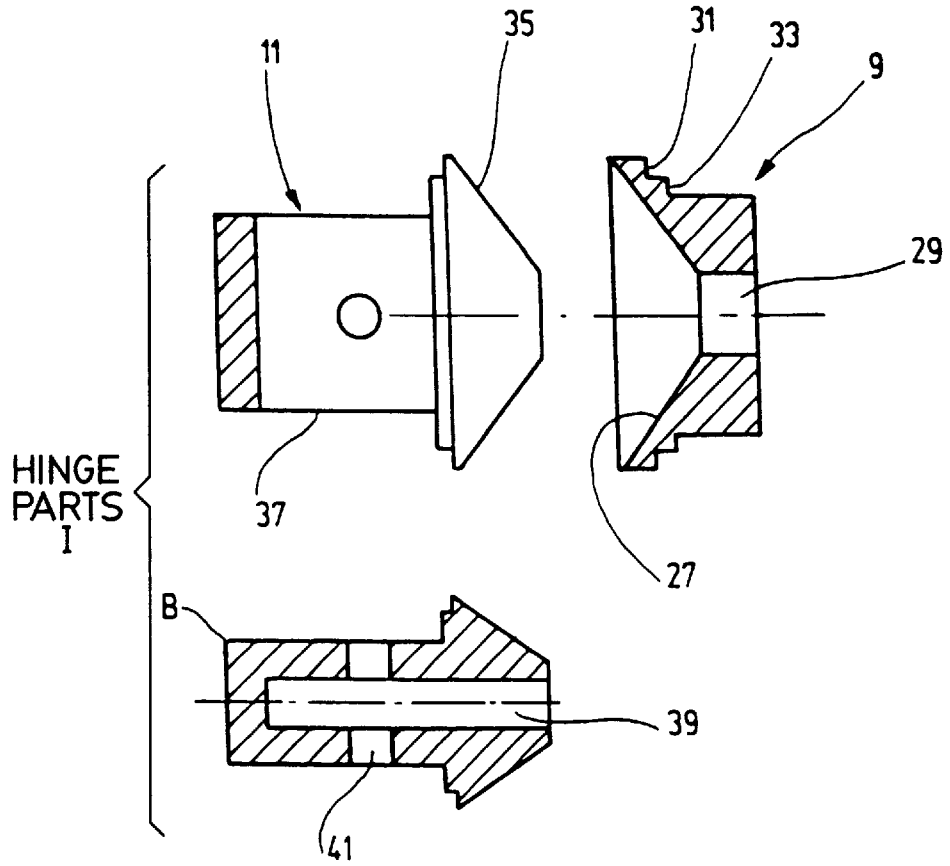
Figure 2:
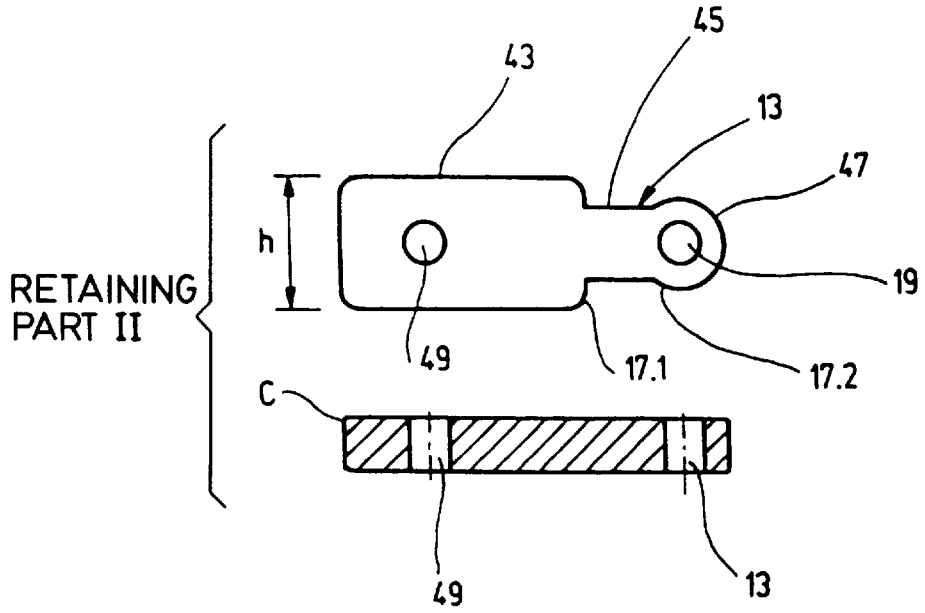

FIG. 2 shows the two hinge parts 9, 11 as well as retaining means or tab 13 again, in isolation.

As is apparent from the sectioned depiction of first hinge part 9 in FIG. 2, conical recess 27 transitions into an opening 29 which passes through the hinge part. This opening 29 is preferably configured as a slot whose one longitudinal side is open at the edge. Hinge part 9 is preferably a rotationally symmetrical object which can easily be manufactured, for example, using an automatic lathe.

It is also evident from FIG. 2 that first hinge part 9 has steps 31, 33. Annular step 31 serves as a stop when hinge part 9 is inserted into part 5.

Second hinge part 11 has a longitudinal segment 35 whose shape is adapted to the shape of recess 27. It is thus of conical configuration. Adjoining this longitudinal segment 35 is a longitudinal segment 37 that is circular in cross section.

In a sectioned depiction B it is evident that hinge part 11 possesses a longitudinally extending slot 39 which is open toward the end of second hinge part 11 that faces toward first hinge part 9. It is also evident that an orifice 41 running perpendicular to slot 39 is provided to receive a pin (not shown). Second hinge part 11 is also preferably configured with rotational symmetry, so that it can be manufactured using an automatic lathe.

Tab 13 also shown in FIG. 2 has an elongated shape, tab 13 being composed of a first longitudinal segment 43, a second longitudinal segment 45, and a third longitudinal segment 47. The two stops 17.1 and 17.2 are constituted by the fact that the second, central longitudinal segment 45 has a lesser height h than the other two longitudinal segments 43, 47. Tab 13 is of rectangular configuration in longitudinal section, as is evident from sectioned depiction C. Tab 13 is preferably embodied as a punched part.

It is also evident from FIG. 2 that tab 13 has an orifice 49 provided in first longitudinal segment 43.

When hinge 7 is in the functional state, segment 35 of second hinge part 11 lies in recess 27 of first hinge part 9. To connect the two hinge parts 9, 11, tab 13 is laid with its second longitudinal segment 45 into opening 29, and longitudinal segment 43 is slid into slot 39 in such a way that orifices 41 and 49 are aligned. For rotatable connection, a pin is inserted into orifice 41 and orifice 49. Because the longitudinal extension of longitudinal segment 45 is greater than the longitudinal extension of opening 29, tab 13 is retained displaceably in the longitudinal direction with respect to first hinge part 9.

As a result of spring 21, as is evident from FIG. 1, longitudinal segment 35 is pulled firmly into receptacle 27, thus effecting a defined position of hinge 7. In this defined position, hinged hoop 1 is closed. When the hinged hoop is opened, i.e. when at least one of the two parts 3, 5 is rotated about an axis running perpendicular to the drawing plane, conical segment 35 is tilted in recess 27. Tab 13 is thereby displaced until stop 17.2 comes to rest against first hinge part 9. Spring 21 is tensioned by the displacement of tab 13, so that a force acting in the direction of hinge part 9 is exerted on tab 13 and thus on second hinge part 11. This force ensures that the two parts 3, 5 are forced back into their original closed position.

Figure 3:
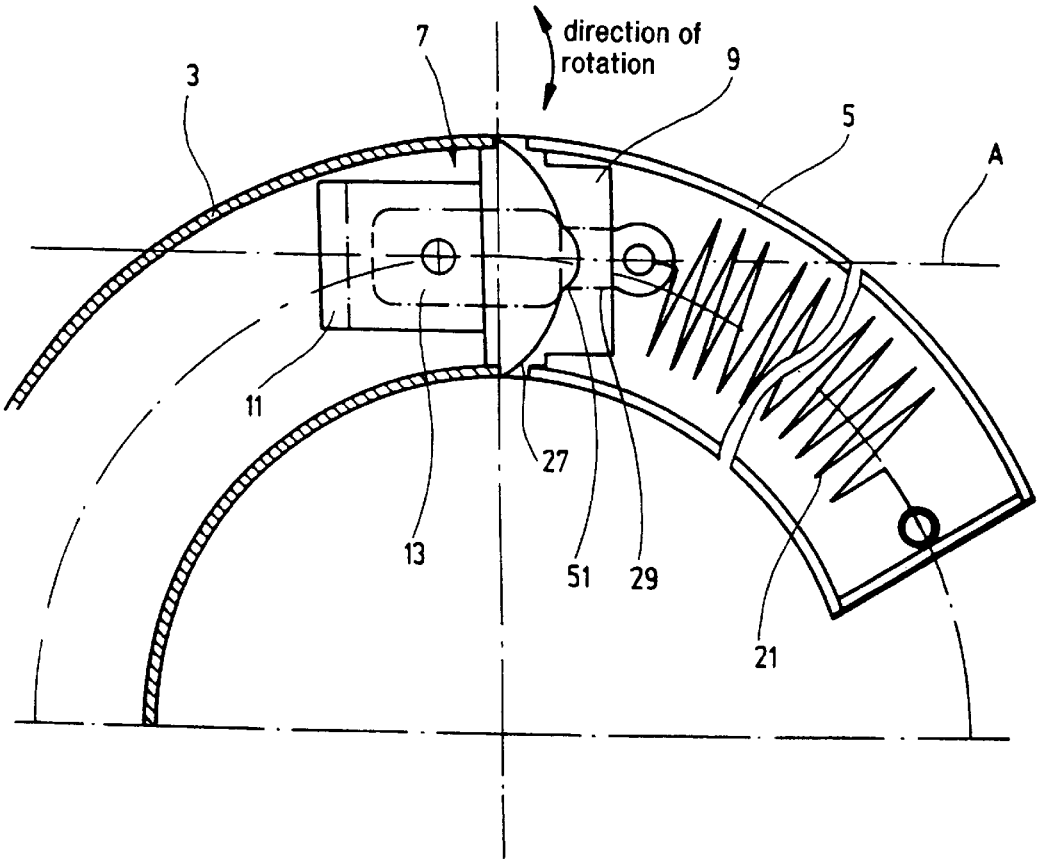
FIG. 3 shows a schematic depiction of a second exemplifying embodiment of a hinge.

FIG. 3 shows a further exemplifying embodiment of a hinged hoop 1 that corresponds substantially to the exemplifying embodiment according to FIG. 1. The only difference is that recess 27 is configured not conically, but rather in the shape of a sphere. A further spherical recess 51 with a smaller diameter is provided in the region of opening 29.

Longitudinal segment 35 of second hinge part 11 is correspondingly configured in such a way that it fits into the shape of recess 27 and 51. With this embodiment as well, tab 13 is displaced, by rotation of at least one of the two parts 3, 5, about a rotation axis running perpendicular to the drawing plane. In contrast to the first exemplifying embodiment according to FIG. 1, second recess 51 guarantees that in the closed state, the two parts 3, 5 assume a defined position with respect to one another.

The extent of the possible rotation of the two parts 3, 5 with respect to one another is determine d substantially by the configuration of recess 27 and by the extent to which tab 13 can be displaced relative t o first hinge part 9.

Figure 4:
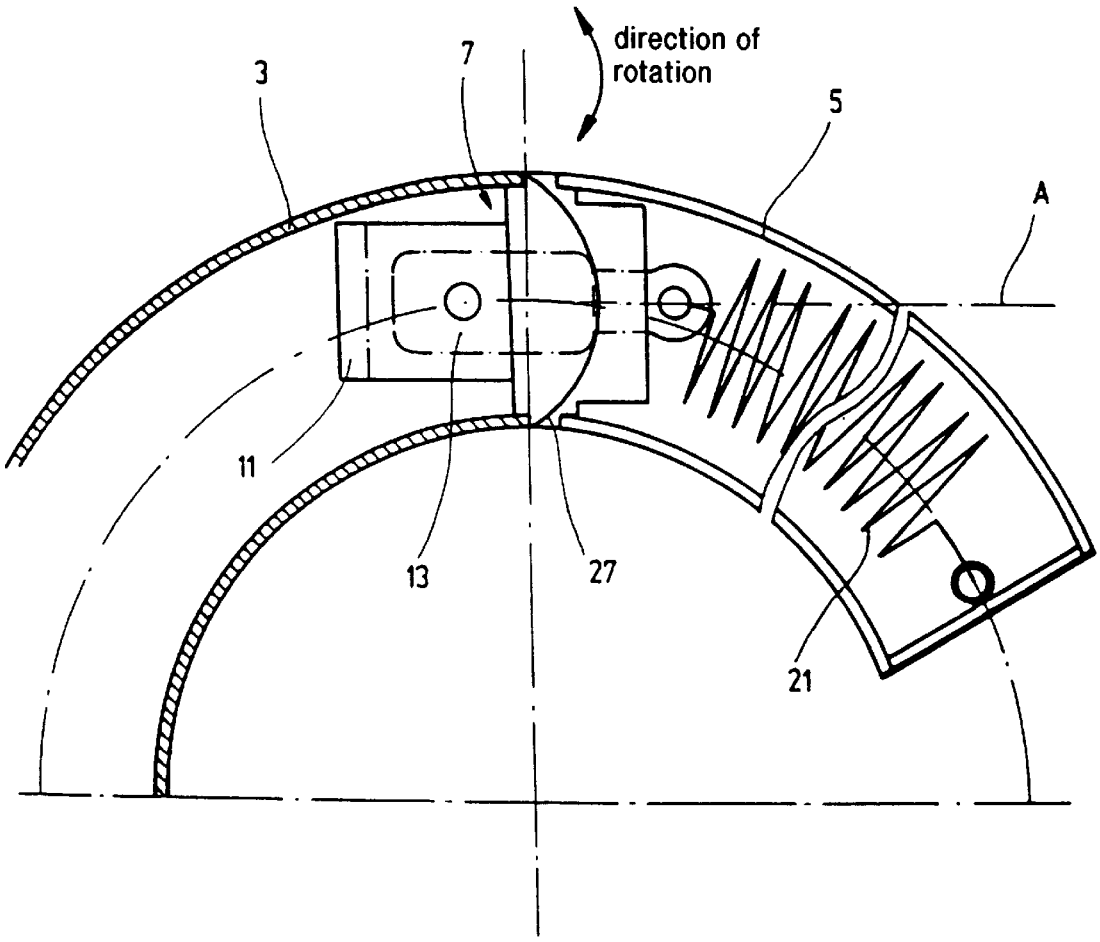
FIG. 4 shows a schematic depiction of a further exemplifying embodiment of the hinge.

FIG. 4 shows a further exemplifying embodiment which differs only insignificantly from the one shown in FIG. 1. The difference lies in the fact that recess 27 is of partially cylindrical configuration, its longitudinal axis (not shown) running perpendicular to the drawing plane. Longitudinal segment 35 of second hinge part 11 is also configured in partially cylindrical fashion, adapted to recess 27. This does not, however, result in any change in the manner in which this hinge functions.

Figure 5:
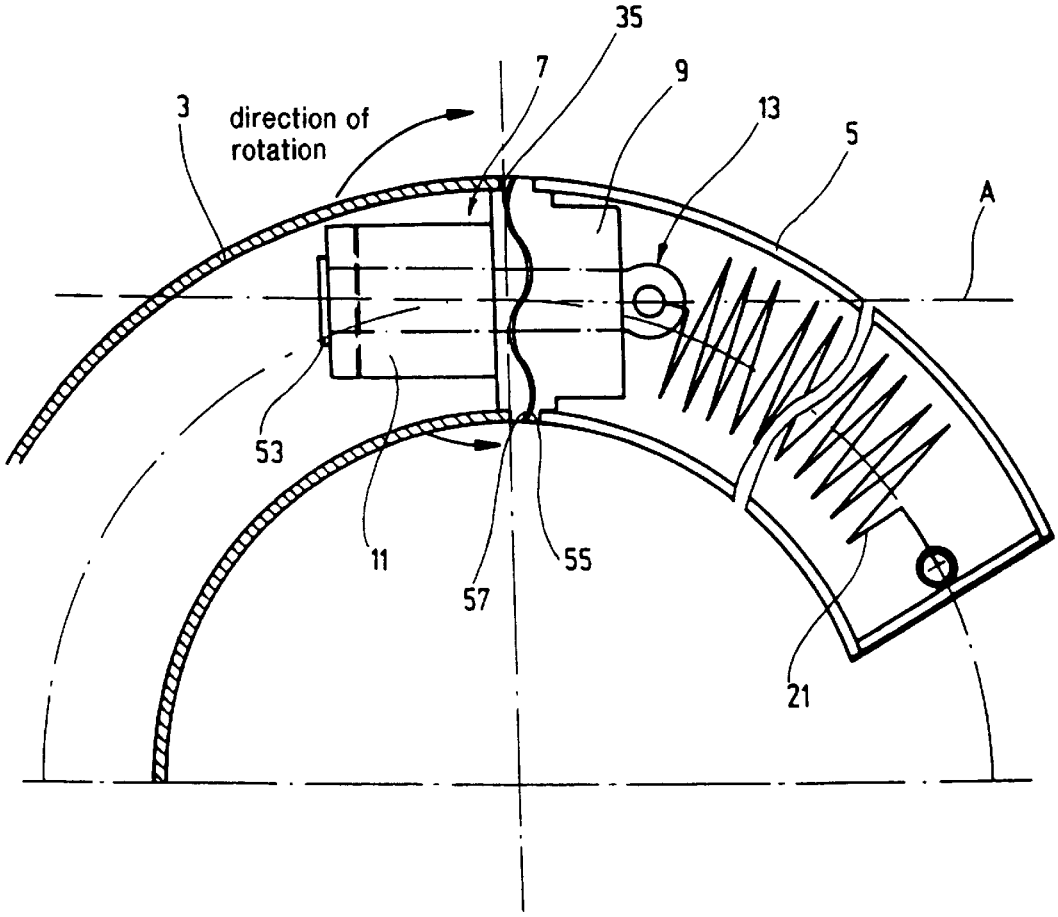
FIG. 5 shows a schematic depiction of a further exemplifying embodiment of the hinge.

FIG. 5 shows a further exemplifying embodiment which differs only insignificantly from the exemplifying embodiment shown in FIG. 1. One difference is the fact that tab 13 passes completely through second hinge part 11, and is retained by a widened segment 53.

A further difference is the fact that longitudinal segment 35 of second hinge part 11, and the side of firs t hinge part 9 facing toward second hinge part 11, possess a fitted-together shape which ensures, when the two parts 3, 5 are rotated about axis A, that the two parts 3, 5 move away from one another in the direction of axis A. In the present exemplifying embodiment, the surface of hinge part 11 facing toward hinge part 9 is labeled with the reference character 57, and the surface of hinge part 9 facing toward hinge part 11 with the reference character 55. As is evident from FIG. 5, the two surfaces 55, 57 resting against one another are of corrugated configuration. Because the spacing between the two parts 3, 5 is increased upon rotation about rotation axis A, tab 13 is displaced with respect to first hinge part 9 so that in this case as well, spring 21 is tensioned.

Figure 6:
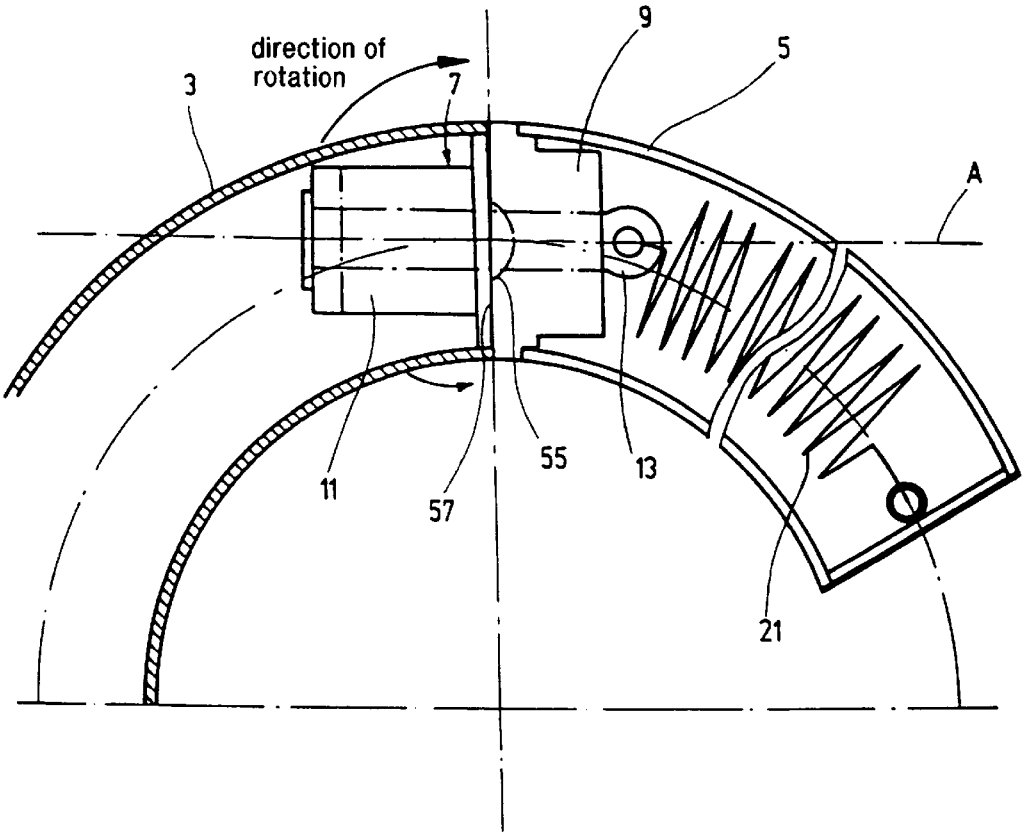
FIG. 6 shows a schematic depiction of a further exemplifying embodiment of the hinge.
Figure 7:
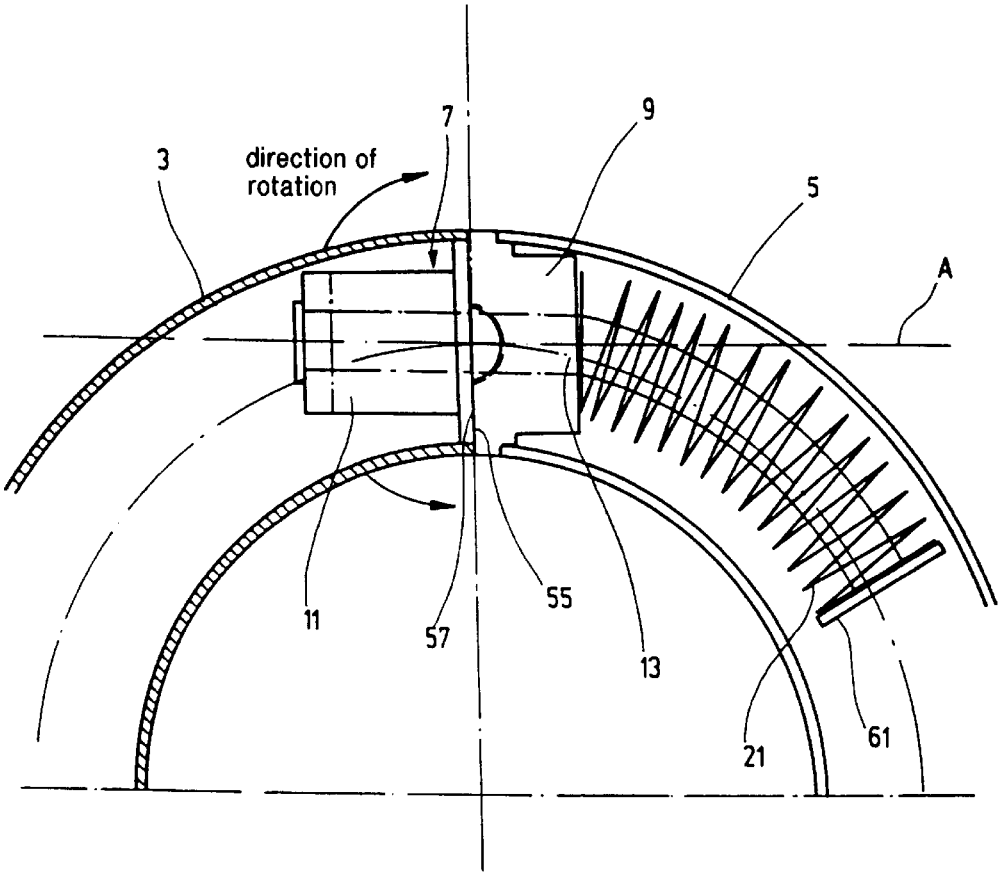
FIG. 7 shows a schematic depiction of a further exemplifying embodiment of the hinge.
Figure 8:
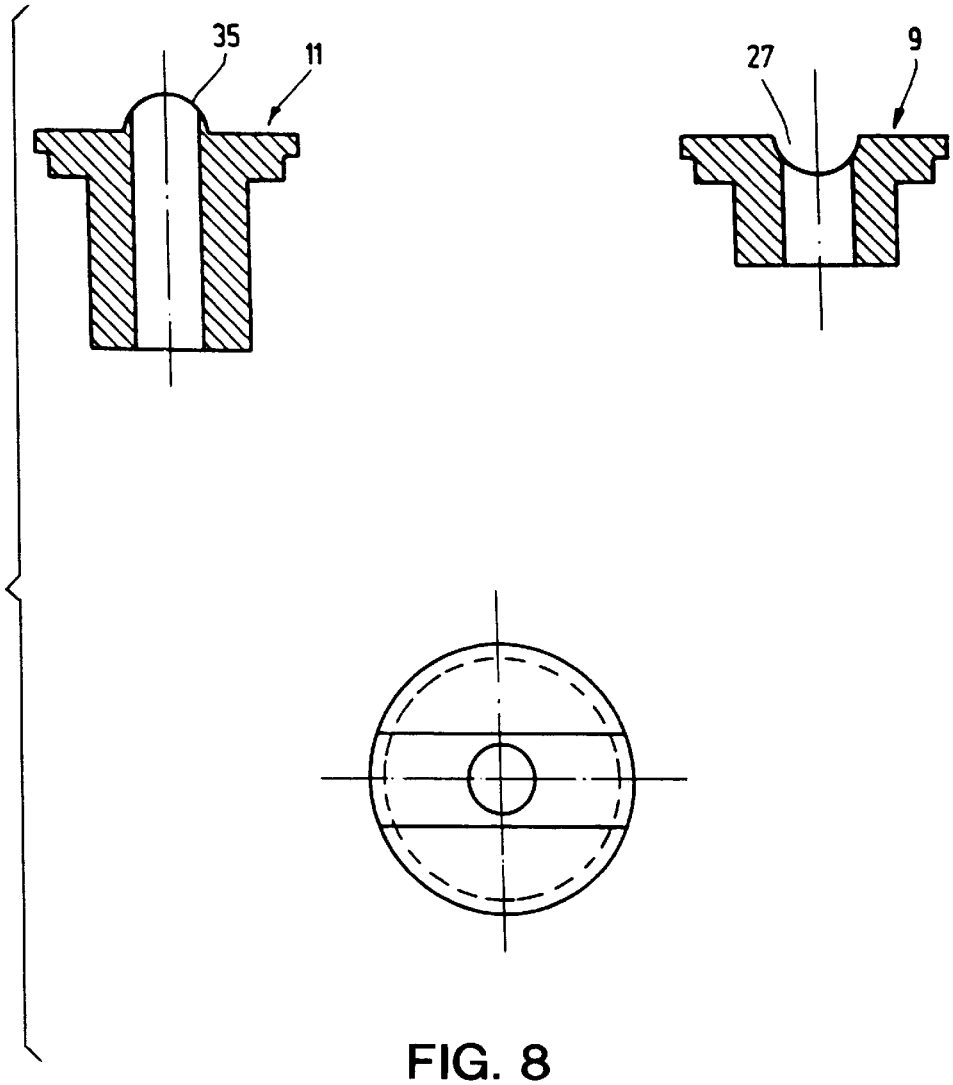
FIG. 8 shows a schematic depiction of the individual parts of the hinge shown in FIG. 7.
Figure 9:
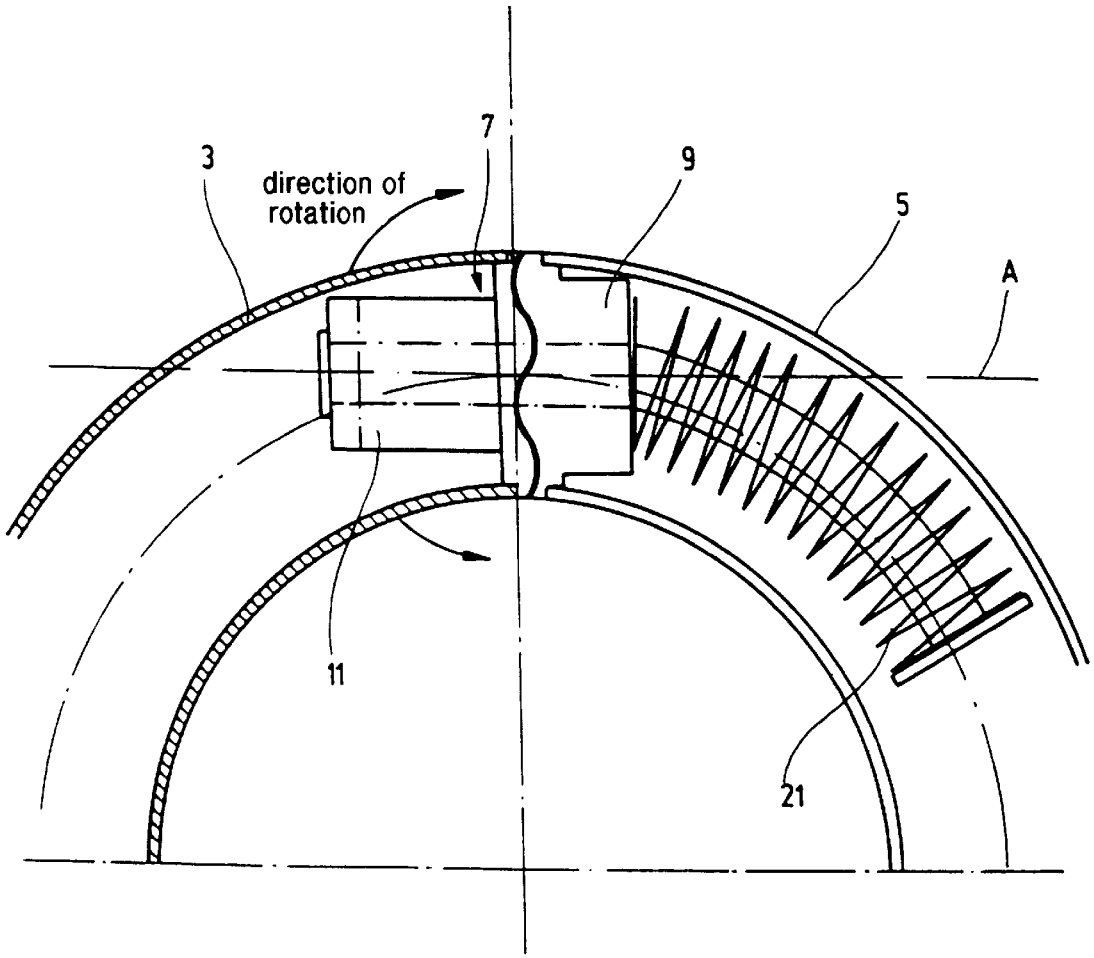
FIG. 9 shows a schematic depiction of a further exemplifying embodiment of the hinge.
Figure 10:
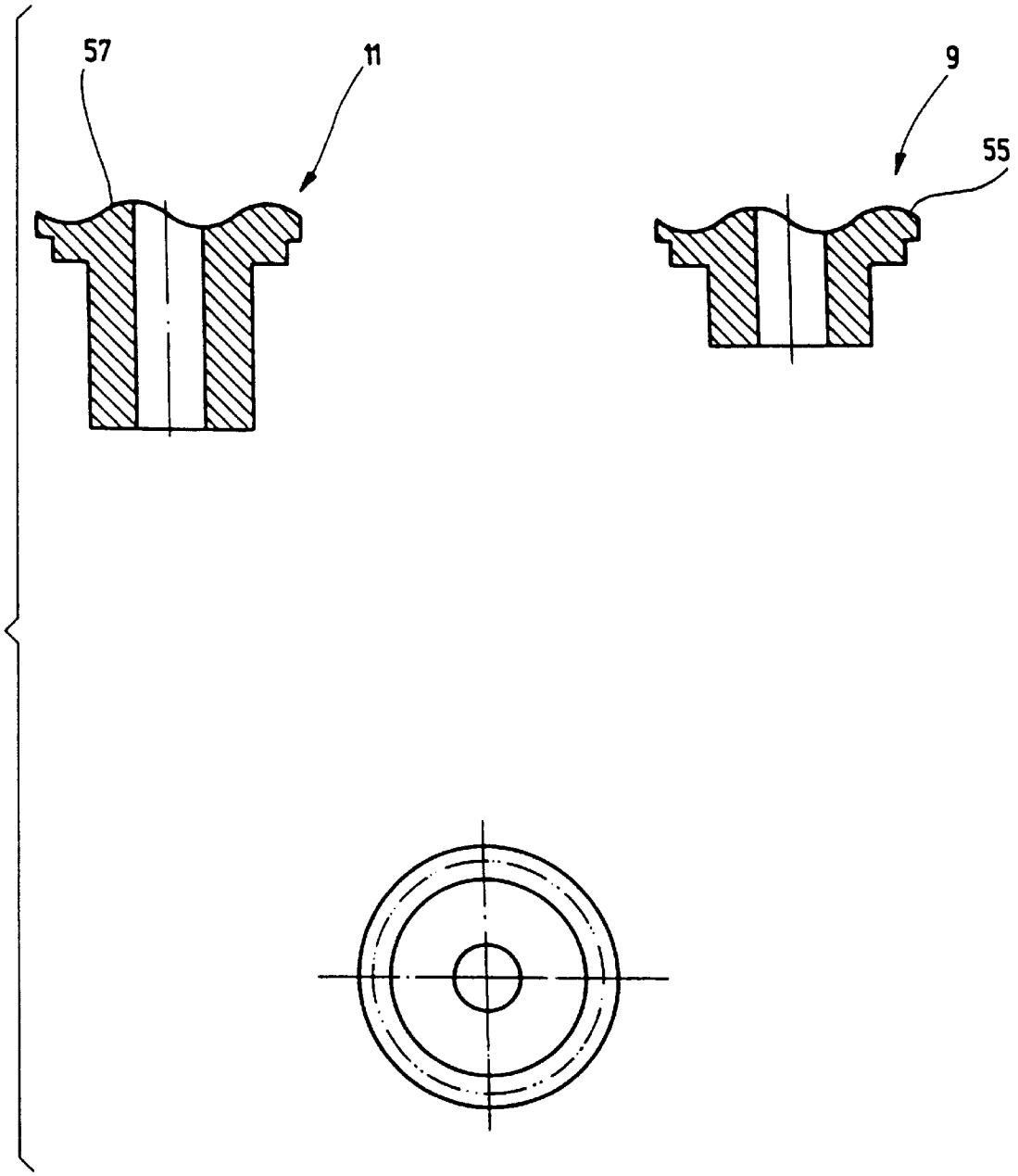
FIG. 10 shows a schematic depiction of the individual parts of the hinge shown in FIG. 9.
Figure 11:
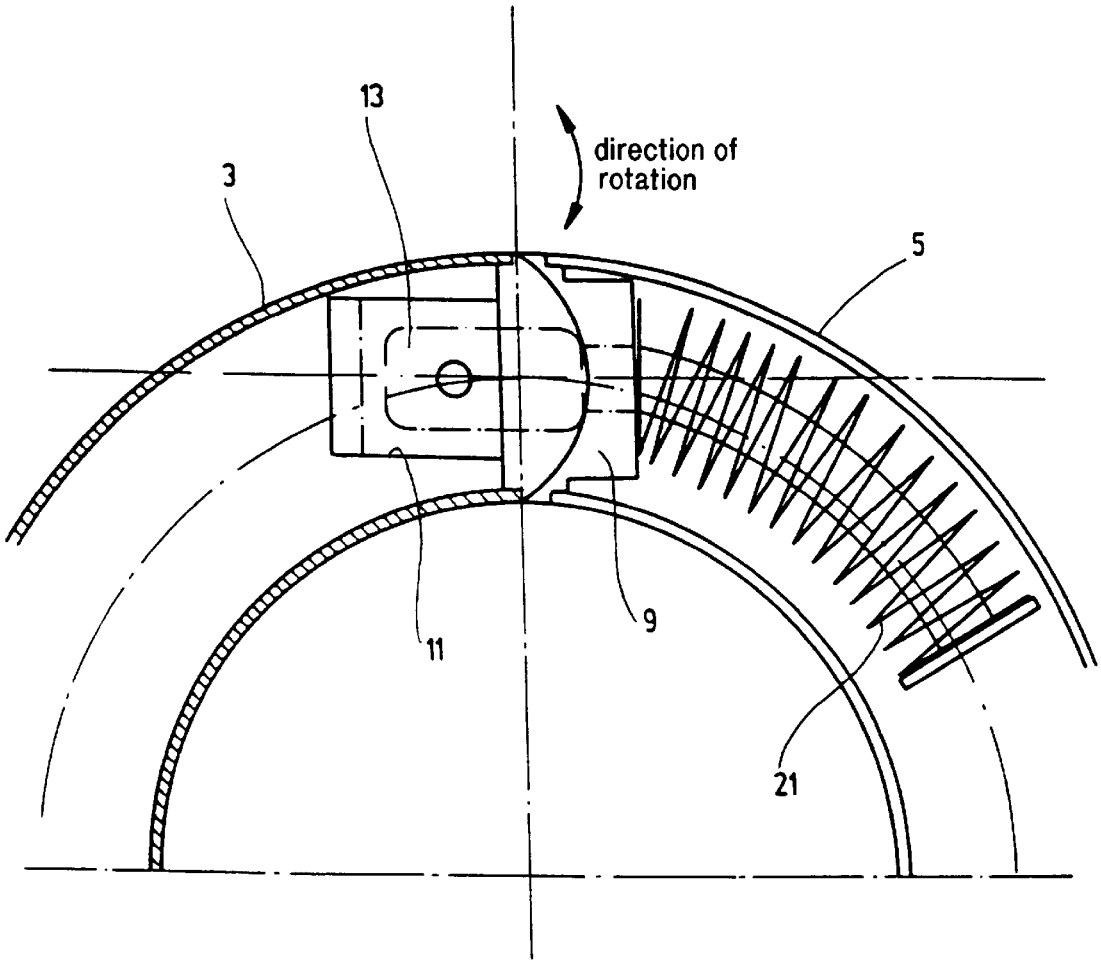
FIG. 11 shows a schematic depiction of a further exemplifying embodiment of the hinge.
Figure 12:
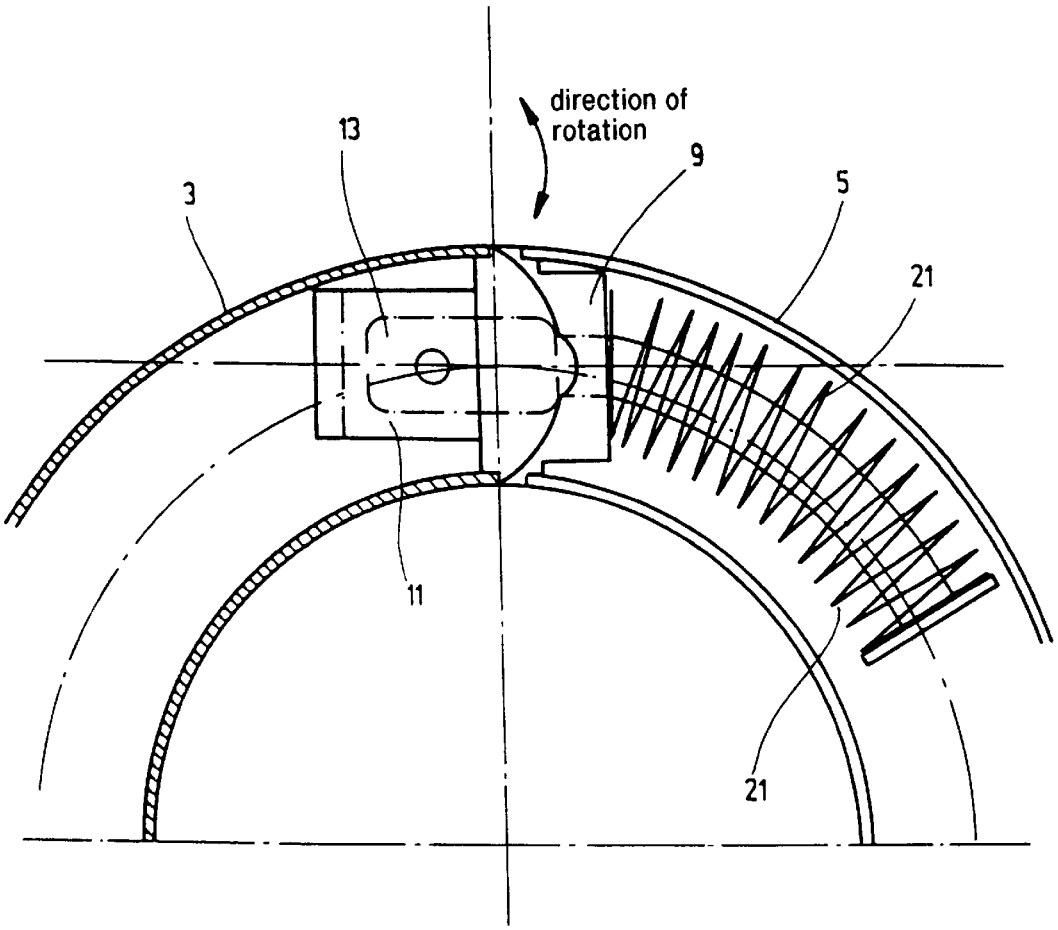
FIG. 12 shows a schematic depiction of a further exemplifying embodiment of the hinge.
Figure 13:
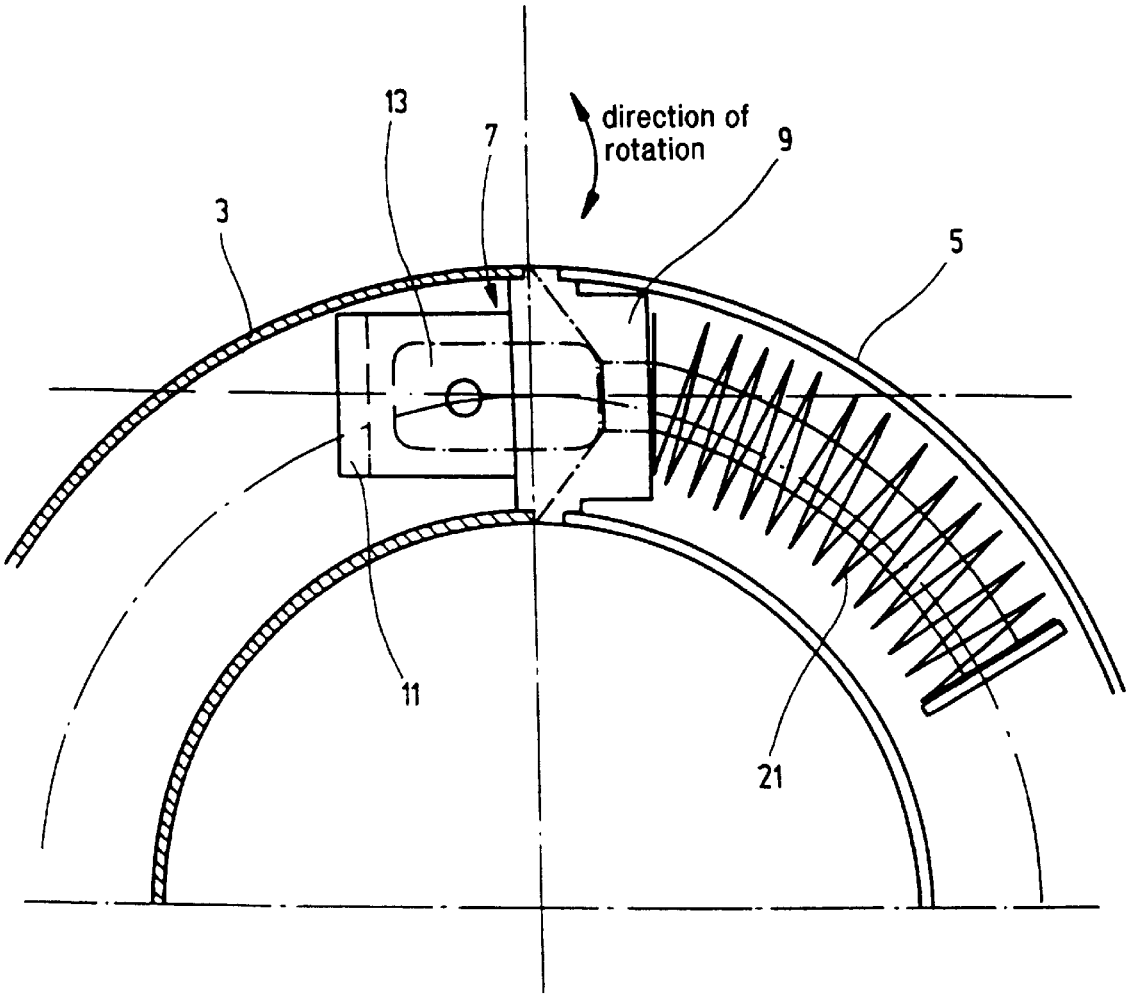
FIG. 13 shows a schematic depiction of a final exemplifying embodiment of the hinge.

The exemplifying embodiment shown in FIG. 6 operates on the same principle. In contrast to the exemplifying embodiment shown in FIG. 5, surface 55 of hinge part 9 has a cylindrical recess into which a cylindrical protrusion, provided on surface 57 of hinge part 11, projects. The longitudinal axis of this cylindrical shape runs perpendicular to the drawing plane. This shape also causes, upon rotation of one of the two parts 3, 5 about axis A, an increase in the spacing between the two parts 3, 5, so that tab 13 is in turn displaced against the force of spring 21.

FIGS. 7 through 13 show further exemplifying embodiments which correspond, in terms of the embodiment of the two hinge parts 9, 11, to the exemplifying embodiments already described with reference to FIGS. 1 through 6. The function and configuration of these hinge parts will therefore not be described again.

The difference in the exemplifying embodiments shown in FIGS. 7 through 13 consists solely in the fact that spring 21 operates, not as before as a tension spring, but now as a compression spring. To achieve this, tab 13 is elongated in the longitudinal direction and has a supporting surface 61 at its end lying in part 5. Spring 21 is now supported on the one hand by first hinge part 9, and on the other hand by supporting surface 61, and thus presses second hinge part 11 against first hinge part 9. When the two parts 3, 5 are rotated with respect to one another, tab 13 is displaced in the longitudinal direction so that spring 21 is thereby compressed.

The advantage of this compression spring mechanism is that the hinge can be completely assembled before it is inserted into the two parts 3, 5, since spring 21 no longer needs to be connected to part 5 via an eye.

The manner in which hinge 7 is manufactured is as follows:

The stamped-out tab 13 is first pushed through the two hinge parts 9, 11. Tab 13 is fastened in the region of second hinge part 11, for example by crimping or soldering. Spring 21 is then pushed onto the elongated segment of tab 13, supporting surface 61 for securing spring 21 being produced, for example, by crimping tab 13. This longitudinal segment of tab 13 is then bent into a shape which corresponds to the shape of part 5. This completely assembled hinge 7 is then inserted into the two parts 3, 5, and attached there, for example, by soldering.

Assembly of the exemplifying embodiments shown in FIGS. 1 through 6 is somewhat more complex, since the hinge cannot be inserted in completely assembled fashion. In addition to the manufacturing steps cited above, spring 21 must be stretched and attached to eye 23 of cover 25, which is then placed onto the end of part 5.

In addition to the exemplifying embodiments described, other configurations of hinge 7, and in particular of recess 27, are of course also conceivable without thereby leaving the context of the invention. Moreover, other spring means besides the helical springs shown are also possible.

What is claimed is:

1. An article of jewelry comprising:

a first (5) and a second part (3);

hinge means (7) for hingedly attaching the first (5) and second parts (3) together, said hinge means having a first hinge part (9) associated with the first part (5), a second hinge part (11) associated with the second part (3), and a retaining element (13), the retaining element (13) connecting the two hinge parts (9, 11) to one another, wherein the hinge means articulatedly connects the two parts (3, 5) in such a way that the parts (3, 5) are movable between a first closed position and a second opened position; and spring means for forcing the two parts (3, 5) into the closed position, said spring means (21) being fastened between the retaining element (13) and the first part (5); wherein the first hinge part (9) comprises a tapering recess (27) having a wall, a base of said recess being an opening (29) passing through the first hinge part;

the second hinge part (11) comprising a longitudinal segment (35) shaped to fit the recess, said longitudinal segment projecting into the recess (27); and the retaining element (13) having a first longitudinal segment (43) engaging through the opening (29), and a second longitudinal segment adjacent thereto (45, 47), a shoulder (17.1) which rests against the wall of the recess (27) being formed between the first (43) and the second longitudinal segment (45, 47), so that the first part (5) is displaced relative to the retaining element (13) during movement into the opened position.

2. The article of jewelry as defined in claim 1, wherein at least the first part (5) is of a hollow configuration, and the spring means (21) is arranged inside the first part (5).

3. The article of jewelry as defined in claim 1, wherein the spring means (21) is a helical spring.

4. The article of jewelry as defined in claim 1, wherein the retaining element (13) is attached rotatably to the second hinge part (11).

5. The article of jewelry as defined in claim 1, wherein a partial cylinder recess (51) is further provided at the base of the recess (27); and the second hinge part (11) has a segment which conforms to the shape of the partial cylinder recess (51) and which fits into the partial cylinder recess (51) when in the closed position.

6. The article of jewelry as defined in claim 1, wherein the first part (5) has a stop element (25) which is spaced away from the first hinge part (9); and the spring means (21) is attached between the stop element (25) and the retaining element (13).

7. The article of jewelry as defined in claim 1, wherein each of the two hinge parts (9, 11) have a surface (55, 57), and a longitudinal axis, said surfaces facing one another; and the surfaces are configured so that a rotation of one of the two parts (3, 5) about its longitudinal axis results in a displacement of that part (3, 5) in the longitudinal direction.

8. The article of jewelry as defined in claim 1, wherein the first longitudinal segment (45, 47) of the retaining element (13) has a supporting surface (61); and the spring means (21) extends along the first longitudinal segment (45, 47) and is supported on the one hand by the supporting surface (61) and on the other hand by the first hinge part (9).

9. The article of jewelry as defined in claim 1, wherein the article is configured as an earring.

10. The article of jewelry as defined in claim 9, wherein the first part and second part (3, 5) are tubular, said first and second parts forming a substantially continuous circular contour.

11. The article of jewelry as defined in claim 1, wherein the article is configured as a bangle.

* * * * *